US006445360B2

(12) United States Patent
Al-Rawi et al.

(10) Patent No.: US 6,445,360 B2
(45) Date of Patent: Sep. 3, 2002

(54) ANTENNA STRUCTURE FOR FIXED WIRELESS SYSTEM

(75) Inventors: Hazim Basheer Al-Rawi, Bath; Andrew John Fox, Chippenham, both of (GB); Anthony Martin, Kuala Lumpur (MY)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/805,081

(22) Filed: Mar. 13, 2001

(30) Foreign Application Priority Data

Mar. 14, 2000 (EP) ..... 00302053

(51) Int. Cl.[7] ..... H01Q 19/13
(52) U.S. Cl. ..... 343/840; 343/781 R
(58) Field of Search ..... 343/840, 872, 343/779, 781 R, 781 CA, 700 MS; 333/21

(56) References Cited

U.S. PATENT DOCUMENTS 4,672,387 A * 6/1987 Waddoup et al. ..... 343/781 P
5,952,972 A * 9/1999 Ittipiboon et al. ... 343/700 MS

FOREIGN PATENT DOCUMENTS

EP 0 361 294 A1 9/1989 ..... H01Q/19/19
GB 2 120 858 A 4/1983 ..... H01Q/1/42
GB 2 268 626 A 7/1992 ..... H01Q/9/04

OTHER PUBLICATIONS

European Search Report Dated Apr. 26, 2000.

* cited by examiner

*Primary Examiner*—Don Wong
*Assistant Examiner*—James Clinger

(57) ABSTRACT

The invention involves a novel mechanical assembly incorporating, in a preferred embodiment, a technically advanced Cassegrain antenna design. The antenna achieves, in experiments, near theoretical performance with the minimum size. The Cassegrain antenna incorporates an intergrated DR array feed.

9 Claims, 7 Drawing Sheets

ANTENNA STRUCTURE FOR FIXED WIRELESS SYSTEM

Cross-Reference To Related Application

This application claims priority of European Patent Application No. 00302053.4, which was filed on Mar. 14, 2000.

FIELD OF THE INVENTION

The present invention relates to a reflective antenna structure, and particularly but not exclusively to a reflective antenna structure suitable for use in a so-called wireless fixed network.

BACKGROUND TO THE INVENTION

In a fixed wireless network a location, such as a business premises or a residential premises, is provided with an antenna associated with a radio system for connection to a telephony network external to the premises. Within the premises, the antenna is connected to a fixed telephony system. In residential premises the fixed telephony system may be a single telephone. In a business premises the fixed telephony system may be a telephone network. Thus a fixed wireless network enables premises in remote locations. where connection to a fixed network infrastructure is difficult or expensive, to connect to such an infrastructure via a radio link.

Many fixed wireless systems rely on high gain directional antenna at a customer's premises to improve system capacity. These antennas are either integrated into the customer's premises unit, or are mounted separately with an RF cable.

In the former case, the gain of the antenna is fixed at manufacture. Such an integrated antenna is typically a planar or flat array antenna. Such an arrangement is inflexible due to the fixed gain which is built in at manufacture.

In the latter case, RF cable losses detract from the antenna gain. These losses become most significant at high frequencies (>2 GHz). Since the 3.4–3.6 GHz band is the favoured residential fixed wireless loop frequency allocation, cable losses can be significant, especially in low cost cables. An example of such an external antenna is a Yagi antenna, connected by RF cable. At 3.5 GHz cable losses make the implementation of such an antenna prohibitive.

SUMMARY OF THE INVENTION

It is an object of the present invention to provide an antenna arrangement, suitable for a fixed wireless system, in which the problems of the two known arrangements described hereinabove are overcome.

According to the present invention there is provided a reflective antenna having a DR (dielectric resonator) array as an integrated feed. The antenna may be a single reflector arrangement. The antenna may be a multi-reflector arrangement. The antenna may be a Cassegrain antenna.

A main reflector may clip onto the DR array. A sub-reflector may be supported by a radome mounted over the main reflector.

The reflective antenna may have a centre operating frequency of 3.5 GHz, in which the sub-reflector diameter is approximately 1.75 $\lambda$ and the main reflector diameter is approximately 5 $\lambda$, an approximate 1.43 $\lambda$ separation distance being provided between the two reflectors.

A wireless communication system may incorporate such a reflective antenna.

A wireless local loop communication system, a wireless access communication system, or a wireless fixed network communication system may incorporate such a reflective antenna.

The invention described herein thus provides a field selectable antenna assembly, the gain of which can be matched to a particular application, without the need for an RF cable.

The invention involves a novel mechanical assembly incorporating, in a preferred embodiment, a technically advanced Cassegrain antenna design. The antenna achieves, in experiments, near theoretical performance with the minimum size.

BRIEF DESCRIPTION OF THE FIGURES

The invention will now be described by way of example with reference to the following Figures, in which.

DESCRIPTION OF PREFERRED EMBODIMENT

Figure 1A:
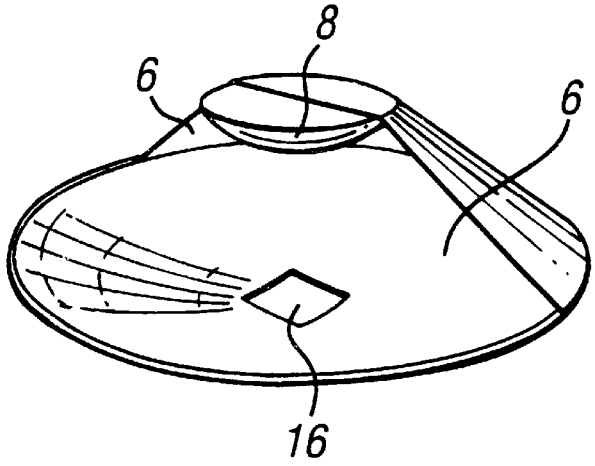
FIGS. 1(*a*) to 1(*f*) illustrate the structure of a Cassegrain antenna according to the preferred embodiment of the present invention.
Figure 1B:
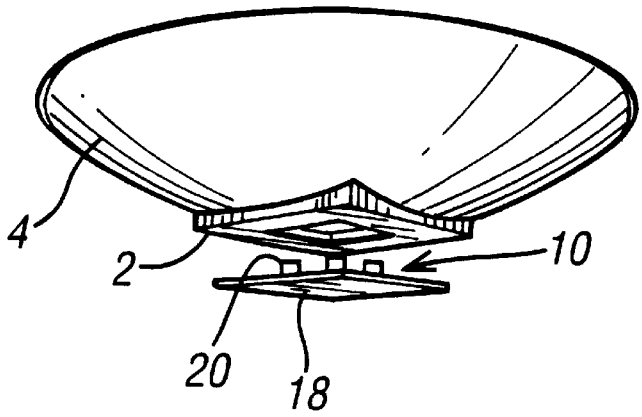
Figure 1C:
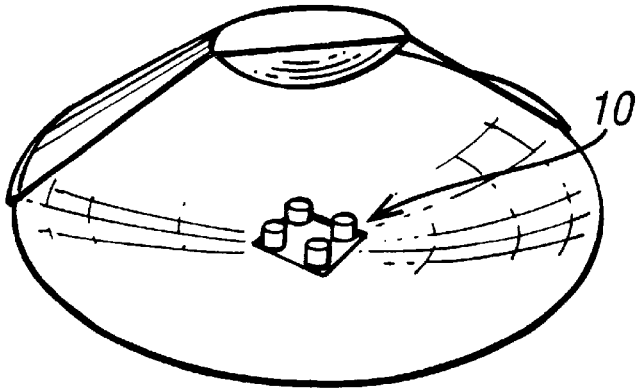
Figure 1D:
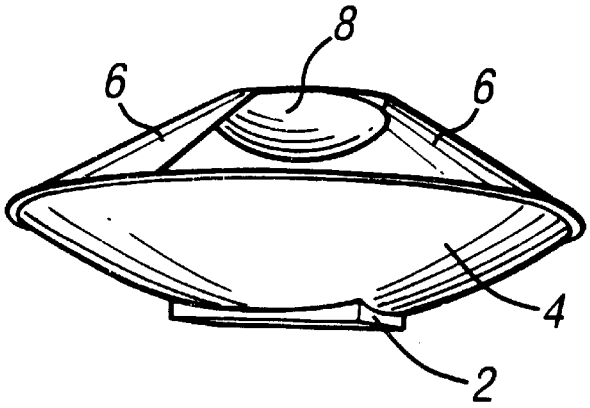
Figure 1E:
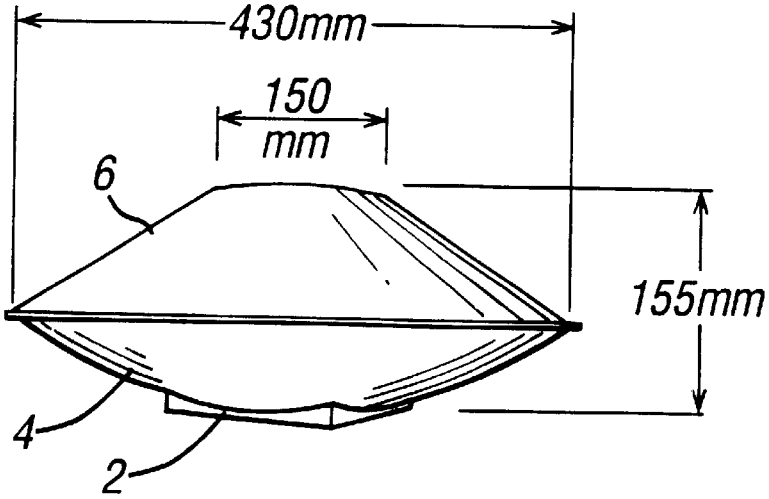
Figure 1F:
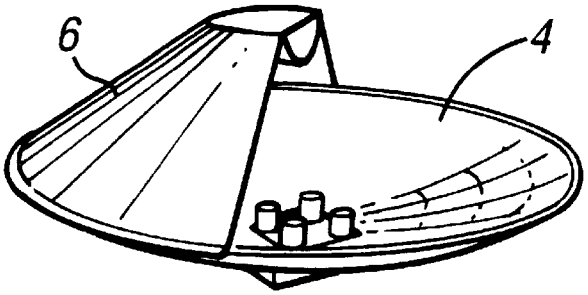
Figure 2A:
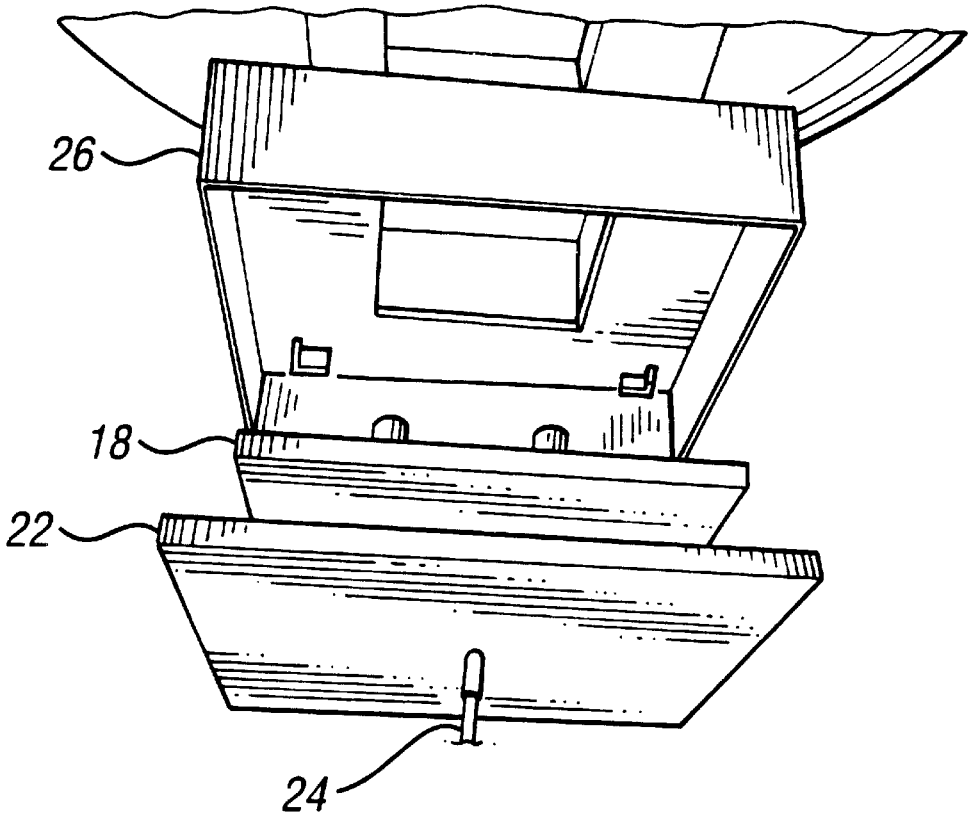
FIGS. 2(*a*) to (*d*) illustrate the assembly of a Cassegrain antenna according to the preferred embodiment of the present invention.
Figure 2B:
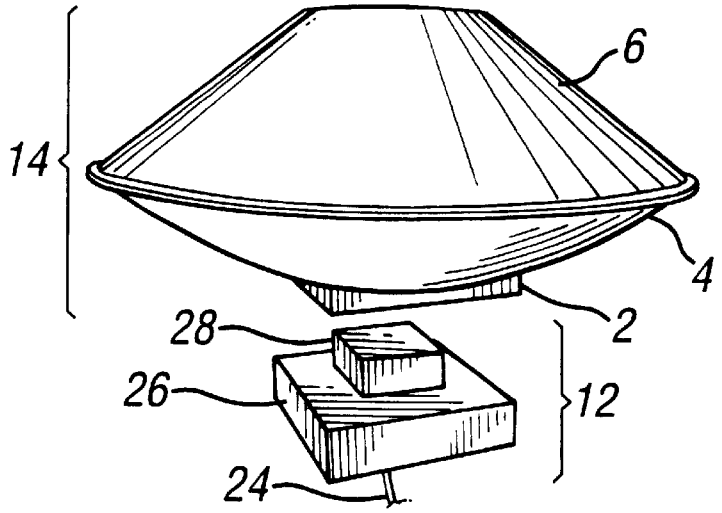
Figure 2C:
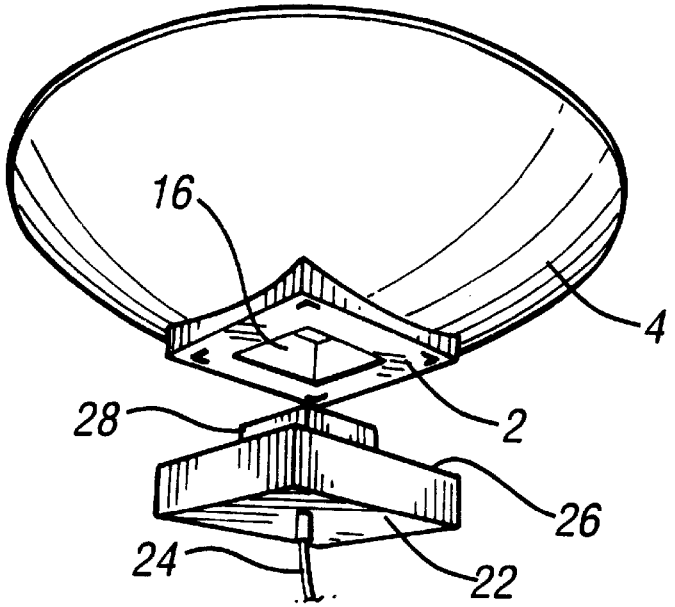
Figure 2D:
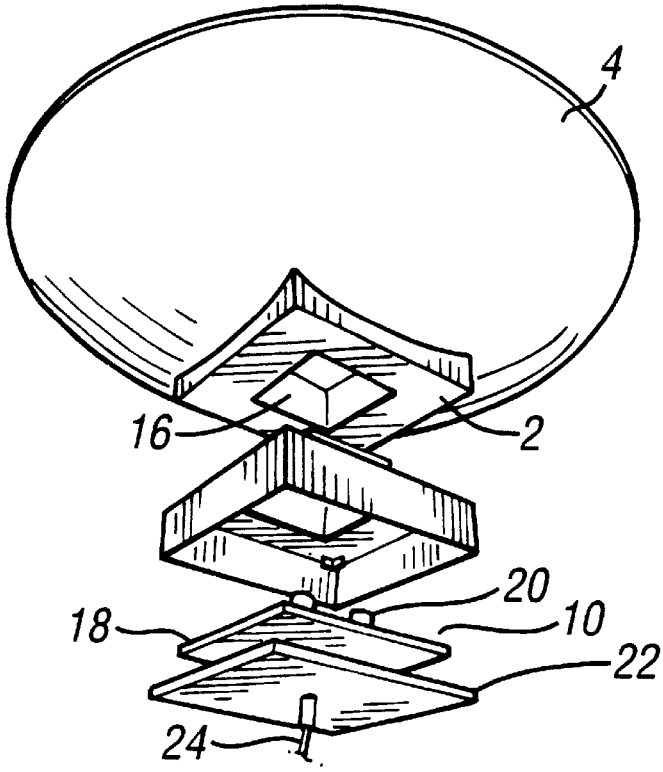

The invention will now be described by way of example to a particular advantageous implementation. It will be understood that the invention is not limited to such an implementation, and may have applicability beyond the example given herein. Where appropriate, modifications to or alternative applications for, the invention are discussed herein.

The invention is discussed herein with specific reference to an example of a so-called wireless fixed network, which arrangements are also commonly referred to as wireless access systems or wireless local loop. In such arrangements a location, such as a business premises or a residential premises, is provided with an antenna associated with a radio system for connection to a telephony network external to the location. Within the location, the antenna is connected to a fixed telephony system. In residential premises the fixed telephony system may be a single telephone. In a business premises the fixed telephony system may be a telephone network.

Typically the antennas associated with such wireless fixed networks are required to be high gain antennas. In accordance with the present invention the antenna for the wireless fixed network is implemented as a Cassegrain antenna arrangement. Further in accordance with the present invention, an RF primary feed is integrated into the customer's premises electronics, and a Cassegrain RF reflector structure is used to focus the radiated energy from a dielectric resonator (DR) array to achieve the desired gain. Thus there is avoided the need for an RF cable.

The resulting design in accordance with the preferred embodiment of the present invention consists of two lightweight, environmentally sealed units: an electronics unit (incorporating the DR primary feed array), and a Cassegrain reflector, as shown in FIGS. 1 and 2.

Referring to FIGS. 1(*a*) to (*f*) and FIGS. 2(*a*) to 2(*d*), the electronics unit is generally designated by reference numeral 12, and the Cassegarin reflector is generally designated by reference numeral 14. The Casegrain antenna arrangement comprises a base 2, a main reflector 4, a radome 6, a sub-reflector 8, and a DR array feed 10.

As can be seen in FIG. 1, the base 2 of the main reflector 4 is provided with an aperture or opening 16. The opening 16 is provided to receive the DR array feed 10. As can be seen from FIG. 1 the DR array feed 10 comprises an array board 18 with the "rods" of the DR array, generally designated by reference numeral 20, mounted thereon. The arrangement of the DR array feed 10 is such that the array board 18 fixes to the base 2, and the DR array rods 20 protrude through the opening 16 into the reflector area of the main reflector 4.

FIGS. 1(*a*) to (*f*) illustrate the main elements of the implementation according to the present invention without the electronics unit shown for ease of clarity. FIGS. 1(*a*) to (*f*) show the arrangement from various different views to fully illustrate the preferred structure. In particular FIG. 1(*a*) shows the arrangement with the front part of the radome 6 cut away. FIG. 1(*d*) similarly shows the arrangement with the front part of the radome cut-away to illustrate the sub-reflector 8. FIG. 1(*f*) again shows half the radome cut-away to show the elements of the DR array protruding through the opening 16 in the main reflector 4.

In the illustrated example, the DR array is shown as a 2×2 array. It will be appreciated that the array may in fact be any size of array, chosen according to the specific implementation.

In manufacture, the inner curved surfaces of the sub-reflector and the main reflector will be finished smooth, with a conductive spray coating.

In practice, the DR array feed 10 is encased before mounting in the assembly, and this is shown in FIGS. 2(*a*) to 2(*d*). Again, FIGS. 2(*a*) to 2(*d*) show an actual possible assembly of the antenna structure from several different views.

Referring to FIG. 2(*a*), the electronics unit 12 consists of an electronics circuit provided on a circuit board 22, fed by a cable 24. The DR array feed 10 is positioned to be mounted directly onto the electronics circuit board 22, with which it is electrically connected. A housing for the electronics unit 12 is then formed by the base of the electronics circuit board 22 and a lid 26, which covers the DR array feed 10. The lid 26 is provided with a protrusion 28 which accommodates the rods 20 of the DR array feed 10, and which fits through the opening 16 of the main reflector 4.

Preferably, the main reflector 4 is provided with means in the base 2 thereof which engage with means on the lid 26 of the electronics unit 12 for securing the electronics unit, including the DR array feed 10, to the main reflector. In an alternative arrangement the DR array feed may be provided with a housing, separate to the electronics unit (but connected directly thereto) for connection to the main reflector. Preferably the means for connecting the DR array feed to the main reflector is a clipping means, such that the main reflector, and the whole Cassegarin reflector structure, can be clipped on and off the DR array feed. Such clipping means should preferably be made from plastic so as to avoid any electromagnetic interference.

Thus at the customer premises the gain of the antenna structure may be varied by replacing the antenna structure mounted to the feed arrangement by simply clipping off one reflector arrangement and clipping on another.

In this way the problem associated with the previously known integrated antenna units (that of fixed gain set in manufacture) is overcome.

Several reflector gain options may be provided, varying from 21 dBi (428 mm) upwards (>428 mm). At installation, the electronics unit is clipped to a reflector unit with an appropriate gain.

For cost and aesthetic reasons, it is desired that the Cassegrain reflector structure must be as small as possible. The prime factor in determining the size of a Cassegrain antenna is the Half Power Beam Width (HPBW) of the primary feed power pattern in both planes. A typical Cassegarin feed (such as a horn feed) would produce a narrow beam, and therefore a compact reflector structure would be possible. However the horn feed itself would be physically large resulting in little or no size reduction. That is the, reflector would have to be made large to accommodate the large horn feed.

According to the present invention, the DR array feed is used to produce a required beamwidth that allows the use of a very small sub-reflector, and consequently a very small main reflector. In addition, the DR array feed itself is compact and light in weight. whilst meeting the necessary electrical requirements of the system, such as bandwidth requirement.

The Cassegrain reflector antenna is generally favoured for its associated high gain. However, its corresponding large size has made its use unattractive in 3 GHz wireless communication systems. The use of the DR array feed as a primary feed in accordance with the invention reduces the size of the antenna substantially compared to a standard Cassegarin structure, whilst keeping the antenna gain competitively high. The high gain will result in a larger coverage and hence significant reduction in the overall infrastructure cost.

In the following, the performance of the Cassegarain structure of FIGS. 1 and 2 according to a preferred implementation of the present invention will be discussed.

In the preferred example of a wireless fixed network, it is necessary (to achieve high gain) to use a Cassegrain structure which generates a narrow beam from the primary feed so that a small sub-reflector may be used. The small sub-reflector in turn requires a smaller main reflector and hence an overall compact Cassegrain antenna is provided,. whilst maintaining the gain competitively high.

Figure 3:
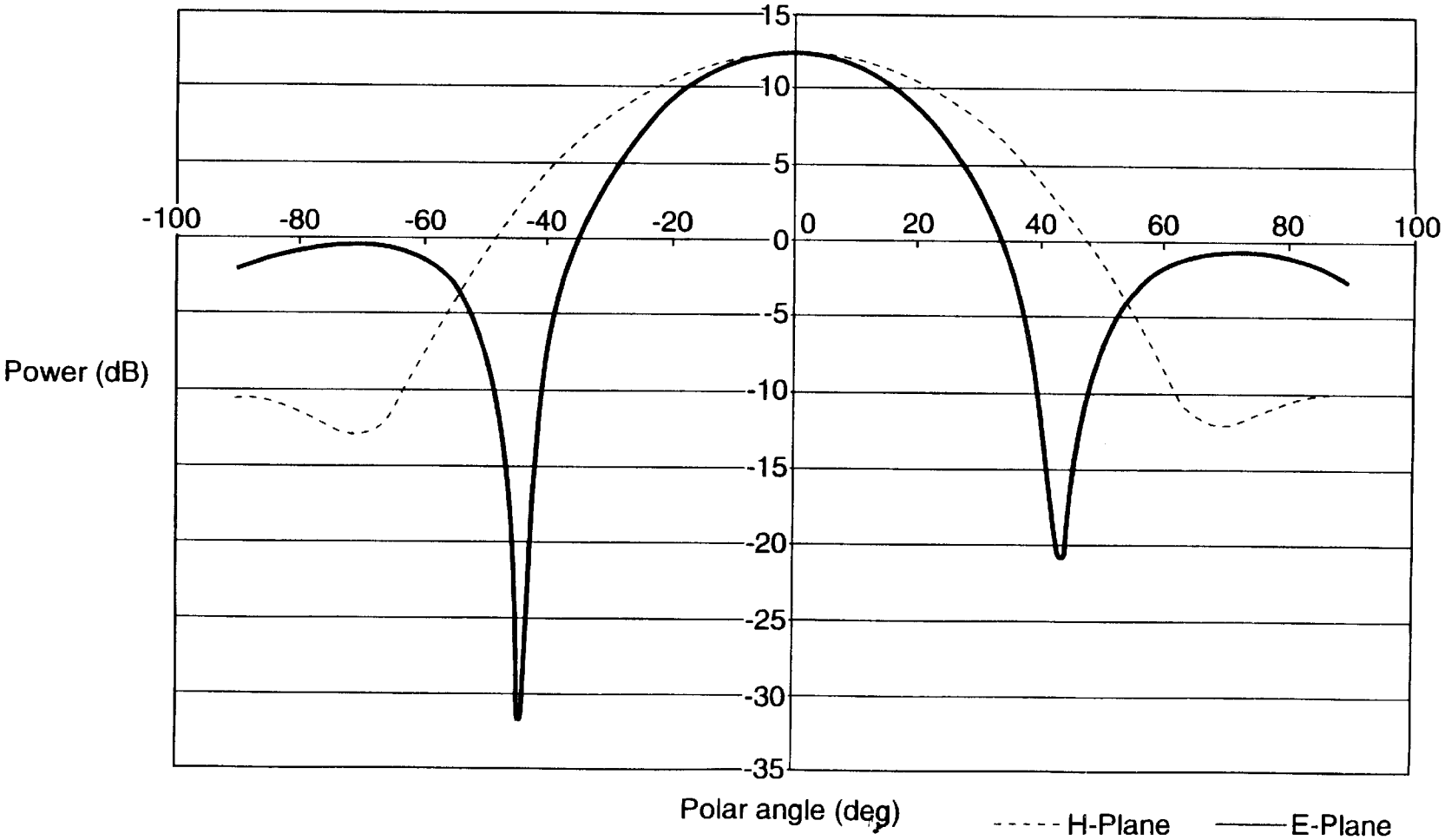
FIG. 3 illustrates, in both planes, the co-polar power pattern of a 2×2 DR array feed used in the Cassegrain antenna according to the preferred embodiment of the present invention.

This has been achieved by using the 2×2 DR array of the preferred implementation, as shown in FIGS. 1 and 2. This arrangement produces a power pattern with a −10 dB taper level of ±32°, as shown in FIG. 3. This pattern is narrow enough to make the sub-reflector diameter ($D_s$) and the main reflector diameter ($D_m$) as small as 1.75 λ and 5 λ, respectively, with a 1.43 λ separation distance between the two reflectors (d).

The Cassegrain arrangement is designed, in the preferred implementation, for a centre operating frequency of 3.5 GHz, giving the dimensions in the previous paragraph. However, due to the availability of DR rods with a designed resonant frequency of 3.732 GHz, the feed array is made, in the preferred embodiment, using such rods. This means that the Cassegrain antenna dimensions, corresponding to $f_r$=3.732 GHz, are $D_s$=1.86 λ, $D_m$=5.32 λ and d=1.53 λ.

Figure 4:
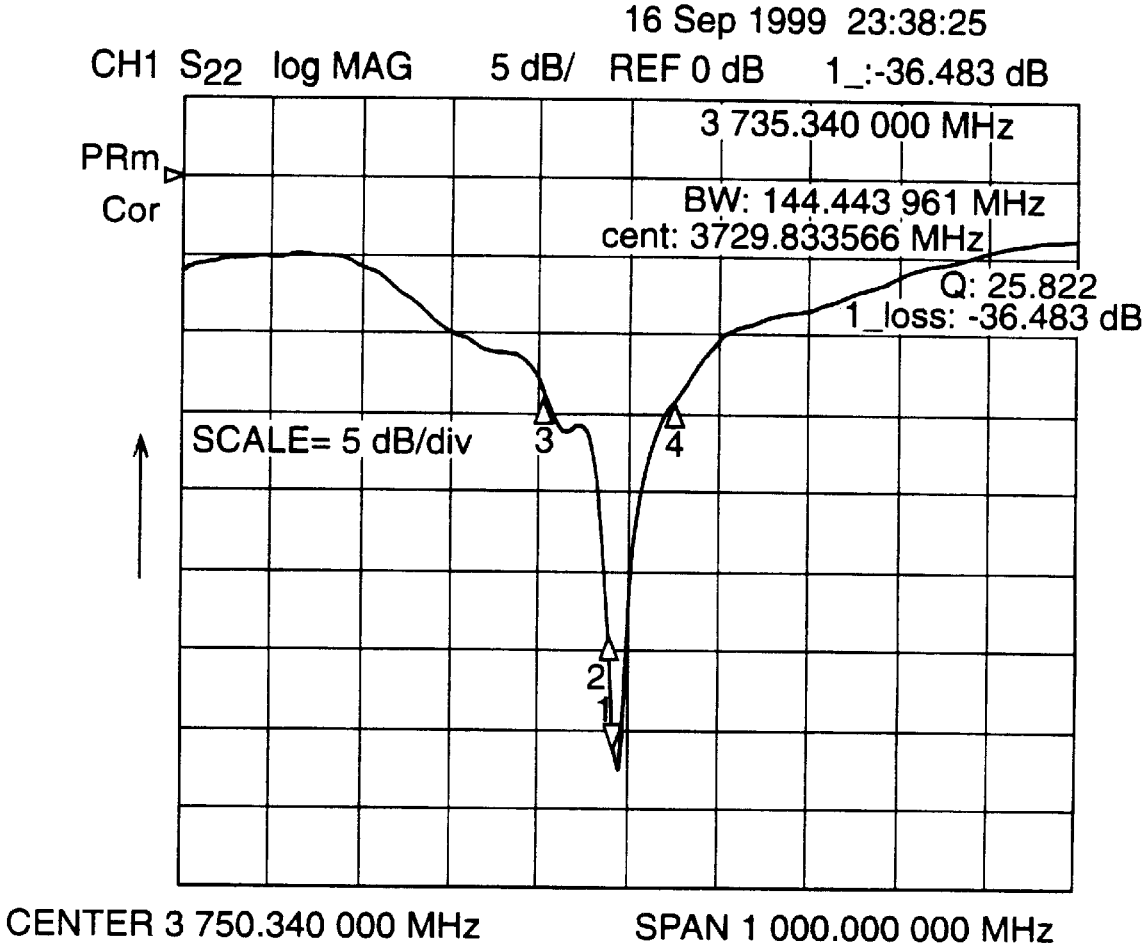
FIG. 4 illustrates the measured return loss of the Cassegarin antenna according to the preferred embodiment of the present invention incorporating a 2×2 DR array feed.
Figure 5:
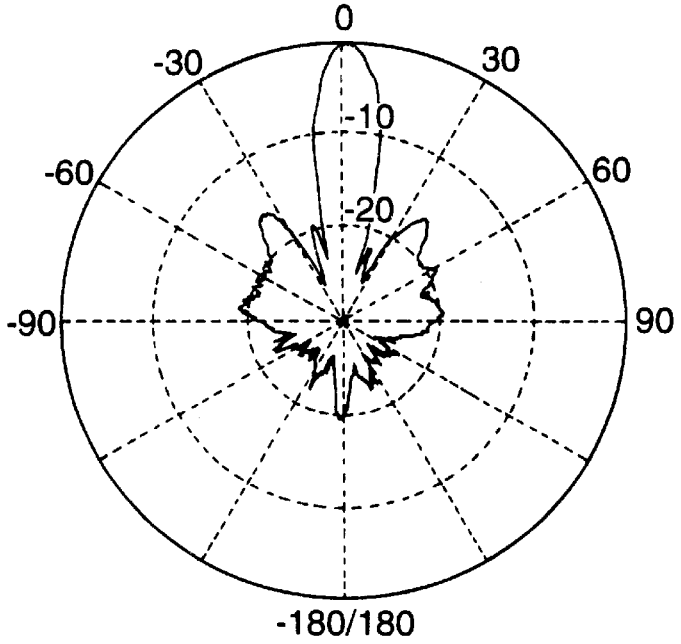
FIG. 5 illustrates, in the azimuth plane, the achieved experimental co-polar power pattern of the Cassegarin antenna according to the preferred embodiment of the present invention incorporating a 2×2 DR array feed.
Figure 6:
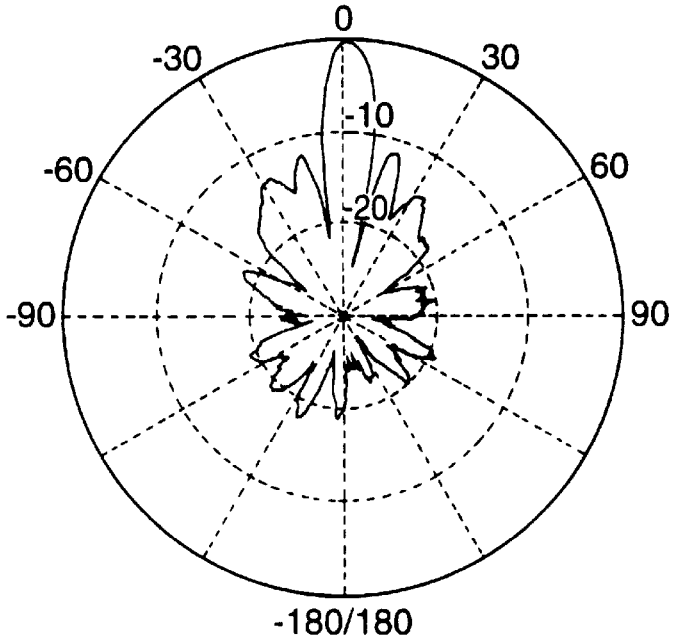
FIG. 6 illustrates, in the elevation plane, the achieved experimental co-polar power pattern of the Cassegarin antenna according to the preferred embodiment of the present invention incorporating a 2×2 DR array feed.

A prototype antenna has been designed in accordance with this preferred embodiment, and constructed and tested in an anechoic chamber. The measured results show a resonant frequency of 3.735 GHz with a return loss (RL) of −36.48 dB and a −14 dB bandwidth of 144 MHz as shown in FIG. 4. The corresponding power gain is 20 dBi, at the resonant frequency. The co-polar power patterns in the azimuth and elevation planes are shown FIG. 5 and FIG. 6, respectively. FIGS. 5 and 6 show a HPBW of 12° and a First Side Lobe Level (FSLL) of −16 dB and a Front-to-Back Ratio (FTBR) of 20 dB.

The cross-polar power level, over the 360° angular range, was found to be so small that it was lost in the noise signal, illustrating that the antenna is correctly polarized.

Thus the invention provides a compact high gain customer premises unit for a wireless fixed network, with at least 21 dBi antenna gain, and with the option to simply increase the gain by ~6–8 dB for areas of poor coverage or for long range operation.

The invention described herein thus provides a field selectable antenna assembly, the gain of which can be matched to a particular application, without the need for an RF cable. For example, a 428 mm antenna with a gain of 21 dBi could be used in a suburban or urban environment, whereas a subscriber in a rural setting could use a 27 dBi antenna at much longer range.

The invention is not limited in its applicability to a Cassegarin reflector structure or to a structure using multiple reflectors. The DR array feed may similarly be utilised as the feed in a single reflector antenna. In such an arrangement, however, it would not be possible to clip the reflector on and off the DR array feed. The use of the integrated DR array feed structure in a single reflector arrangement results in reduction of the size of the reflector itself compared with other types of feed.

The invention may be utilised in any antenna arrangement for a wireless communications system.

What is claimed is:

1. A reflective antenna comprising a dielectric resonator array as an integrated feed.

2. The reflective antenna of claim 1 in which the antenna is a single reflector arrangement.

3. The reflective antenna of claim 1 in which the antenna is a multi-reflector arrangement.

4. The reflective antenna of claim 1 in which the antenna is a Cassegrain antenna.

5. The reflective antenna of claim 2 in which a main reflector clips onto the dielectric resonator array.

6. The reflective antenna of claim 5 in which a sub-reflector is supported by a radome mounted over the main reflector.

7. The reflective antenna of claim 2 having a centre operating frequency of 3.5 GHz, in which the sub-reflector diameter is approximately 1.75 $\lambda$ and the main reflector diameter is approximately 5 $\lambda$, an approximate 1.43 $\lambda$ separation distance being provided between the two reflectors.

8. A wireless communication system comprising a reflective antenna having a dielectric resonator array as an integrated feed.

9. A wireless local loop communication system, a wireless access communication system, or a wireless fixed network communication system comprising a reflective antenna having a dielectric resonator array as an integrated feed.

* * * * *